US005835456A

United States Patent [19]

Farine et al.

[11] Patent Number: 5,835,456

[45] Date of Patent: Nov. 10, 1998

[54] TIMEPIECE INCLUDING AN ELECTRIC POWER GENERATOR

[75] Inventors: Pierre-André Farine; Ermanno Bernasconi, both of Neuchâtel, Switzerland

[73] Assignee: Asulab S.A., Bienne, Switzerland

[21] Appl. No.: 984,992

[22] Filed: Dec. 4, 1997

[30] Foreign Application Priority Data

Dec. 9, 1996 [CH] Switzerland ..... 3013/96

[51] Int. Cl.[6] ..... G04B 9/00; G04B 1/00

[52] U.S. Cl. ..... 368/66; 368/204

[58] Field of Search ..... 368/64, 66, 203–205, 368/140, 147, 149, 151, 157; 322/29

[56] References Cited

U.S. PATENT DOCUMENTS

| | | | |
|---|---|---|---|
| 3,849,717 | 11/1974 | Walz et al. | 321/15 |
| 4,760,564 | 7/1988 | Odagiri | 368/66 |
| 4,799,003 | 1/1989 | Tu et al. | 322/29 |
| 4,939,707 | 7/1990 | Nagao | 368/64 |
| 5,001,685 | 3/1991 | Hayakawa | 368/604 |
| 5,517,469 | 5/1996 | Wiget | 368/140 |
| 5,699,322 | 12/1997 | Born | 368/66 |
| 5,740,131 | 4/1998 | Bernasconi | 368/148 |

FOREIGN PATENT DOCUMENTS

| | | |
|---|---|---|
| 0 695 978 | 2/1996 | European Pat. Off. . |
| 24 02 603 | 7/1975 | Germany . |
| 39 06 861 | 9/1989 | Germany . |

OTHER PUBLICATIONS

Acte Du Congres, No. 1, 23 Sep. 1988, pp. 81–85, XP000035001 Hayakawa M: "A Study of the New Energy System for Quartz Watches (II) –The Effective Circuit for the System".

*Primary Examiner*—Vit W. Miska

*Attorney, Agent, or Firm*—Griffin, Butler Whisenhunt & Szipl

[57] ABSTRACT

Timepiece including:

a spring (1*a*) housed in said barrel (1), an electric power generator (2) coupled to said barrel (1), a rectifier circuit (4) connected to said generator, and a regulator circuit (6) supplied by the direct voltage (Ua) from the rectifier circuit and intended to control the rotational speed of the generator (2).

The rectifier circuit (4) comprises:

a voltage doubler rectifier (20) connected to the output of the generator (2), a first capacitor (23) and a first diode (21) connected in series between said first output terminal (20*a*) of the rectifier (20) and the first output terminal (B2) of the generator (2), et a second capacitor (24) and a second diode (22) connected in series between the first output terminal (B2) of the generator (2) and the second output terminal (20*a*) of the rectifier (20).

6 Claims, 1 Drawing Sheet

TIMEPIECE INCLUDING AN ELECTRIC POWER GENERATOR

The present invention concerns an electronic timepiece and in particular a timepiece of this type wherein the electric power is generated by a generator driven by the main spring of a barrel.

A timepiece having these features, which is disclosed for example in Swiss Patent Application No. 686 332, has the same precision as a conventional electronic timepiece due to the fact that the reference pulses, whose frequency determines the speed of rotation of the rotor of the generator and thus that of the hands for displaying the current time, are generated from a signal provided by a quartz oscillator.

Moreover, this timepiece includes neither batteries nor an accumulator since the supply of its electronic circuits is assured by the electric power provided by its generator whose rotor is connected to its mechanical energy source, which is formed by the main spring of a barrel similar to that which is used in conventional mechanical timepieces.

This represents a clear advantage with respect to a conventional electronic timepiece whose circuits are supplied by a battery or an accumulator whose lifespan is limited.

In the timepiece disclosed in the aforementioned Swiss Patent Application, the means for braking the generator rotor are formed by a resistor connected in series to an electronic switch, the unit formed by this resistor and this switch being connected in parallel to the generator coil.

Moreover, this switch is directly controlled by the comparison signal so as to be regularly closed when the latter is in its first state, i.e. as long as the generator rotor is ahead with respect to the position which it would occupy if it had rotated at its desired speed.

It may thus happen that this rotor is braked without interruption during quite a long period of time, in particular if it has previously been accelerated strongly by an angular shock.

The electronic circuits of the timepiece are supplied by a direct voltage provided by a circuit for rectifying the alternating voltage generated by the generator.

The value of this direct voltage, which depends upon the value of this alternating voltage, must obviously be permanently sufficient for the electronic circuits to operate properly.

When the generator rotor is braked, the lower the value of the braking resistor, the lower the alternating voltage which is generated, this alternating voltage obviously being zero if the value of the braking resistor itself is zero.

If the generator rotor was only braked during relatively short periods, the electronic circuits of the timepiece could be supplied, during these braking times, by the electric energy stored in the capacitor or capacitors generally included in the rectifier circuit supplying these circuits, even if the braking resistor value was zero.

However, as was seen hereinbefore, the generator rotor may be braked without interruption during quite a long period of time. It is thus practically impossible to select a zero value for the braking resistor, since the capacitor of the rectifier circuit would then have to have a very high capacitance and would therefore necessarily be expensive and require a lot of space. It would also not be possible to determine with certitude the capacitance which this capacitor should have since the maximum time during which the generator rotor may be braked cannot be predicted in advance.

When the braking resistor is connected in parallel to the generator coil, the alternating voltage generated by this coil is decreased, on the one hand, because of the reduction in the speed of rotation which results from this connection and, on the other hand, because of the voltage drop generated in the generator coil by the current absorbed by the braking resistor.

Consequently, in order for the supply voltage of the electronic circuits of the timepiece always to be sufficient, it is not enough for the value of the braking resistor not to be zero, as was seen hereinbefore, but this value must additionally be relatively high.

However, the lower the braking resistor value, the higher the braking torque applied to the generator rotor, this braking torque being maximum when this braking resistor has a zero value.

This braking torque must obviously subject the generator rotor to a speed of rotation lower than its desired speed whatever the driving torque supplied by the main spring of the barrel.

In order for the maximum value of this driving torque to be as high as possible, which has a favourable effect on the autonomy of the timepiece, i.e. the time during which it can operate without the main spring of the barrel having to be rewound, the braking torque must also therefore be high, which means that the braking resistor has a low value. Preferably, this resistor should have a zero value.

The braking resistor of the rotor thus must fulfil two contradictory conditions. On the one hand, it must be sufficiently high, and in any case not zero, for the supply voltage of the electronic circuits to be sufficient in all circumstances. On the other hand, it must be quite low, and preferably zero, for the braking torque to be high and the speed of rotation of the rotor, when it is braked, to be less than its desired speed even when the driving torque supplied by the mechanical energy source is maximum.

In order for the first condition hereinbefore to be able to be fulfilled more easily, the number of turns of the generator coil could theoretically be increased. But a coil having a larger number of turns is voluminous and may be difficult to house in the restricted space available in a timepiece of small dimensions such as a wristwatch. If one chooses to make this coil with a wire of sufficiently small diameter for it not too take up too much space, the manufacturing thereof becomes difficult and its cost price increases.

Account must also be taken of the fact that a coil having a large number of turns made of a wire of small diameter has a high internal resistance which, on the one hand, adds to the braking resistor and reduces the braking torque of the rotor and, on the other hand, causes an decrease in the alternating voltage generated by the generator when the current supplied by the latter flows through it.

In order for the second aforementioned condition to be fulfilled more easily, the maximum value of the driving torque supplied by the main spring of the barrel which drives the generator rotor may of course be decreased. But the autonomy of the timepiece is then decreased, which is obviously undesirable.

An object of the present invention is to propose a timepiece of the same type as that which is described hereinbefore, but which does not have the drawbacks of the latter, i.e. a timepiece wherein the value of the braking resistor of the rotor may also be very low, or even zero, without it being necessary to give the generator coil a high number of turns and without the risk of seeing, in any circumstances, the supply voltage of the electronic circuits become insufficient for the latter to operate properly. Moreover, this very low, or even zero value of the braking resistor, allows the main spring of the barrel which drives the generator rotor to be selected so that its maximum torque is high and the autonomy of the timepiece is thus higher, all other things being equal, than that of the aforementioned known timepiece.

The invention thus concerns a timepiece including a barrel, a spring housed in the barrel, time display members mechanically coupled to the barrel, an electric power generator also mechanically coupled to the barrel and arranged to supply an alternating voltage across first and second output terminals, a rectifier circuit connected to the first and second output terminals of the generator across two respective input terminals and arranged to supply a direct voltage across two output terminals from the alternating voltage, and a regulator circuit supplied by the direct voltage and intended to control the rotational speed of the generator so as to subject the display members to a rotational speed corresponding to a correct indication of the current time. The timepiece is characterised in that the rectifier circuit comprises a voltage doubler rectifier, connected to the first and second output terminals of the generator and arranged to supply a direct voltage across a first output terminal and a second output terminal so that the potential at the first output terminal is greater than the potential at the second output terminal, a first capacitor and a first diode connected in series between the first output terminal of the voltage doubler rectifier and the first output terminal of said generator, the first diode being oriented in order to allow a current to flow from the first output terminal of the voltage doubler rectifier to the first output terminal of the generator, a second capacitor and a second diode connected in series between the first output terminal of the generator and the second output terminal of the voltage doubler rectifier, the second diode being oriented in order to allow a current to flow from the first output terminal of the generator to the second output terminal of the voltage doubler rectifier.

As a result of this arrangement, the rectifier circuit is arranged for multiplying the supply voltage by a even factor at least equal to four without requiring a high number of cumbersome elements. Thus the timepiece according to the invention may have a very low rotor braking resistance value, without it being necessary to give the generator coil a high number of turns and without there being a risk of seeing, in any circumstances, the supply voltage of the electronic circuits become insufficient for the latter to operate properly.

Other features and advantages of the present invention will appear more clearly upon reading the following description, said description being made by way of non limiting example and with reference to the annexed drawings, in which.

Figure 1:
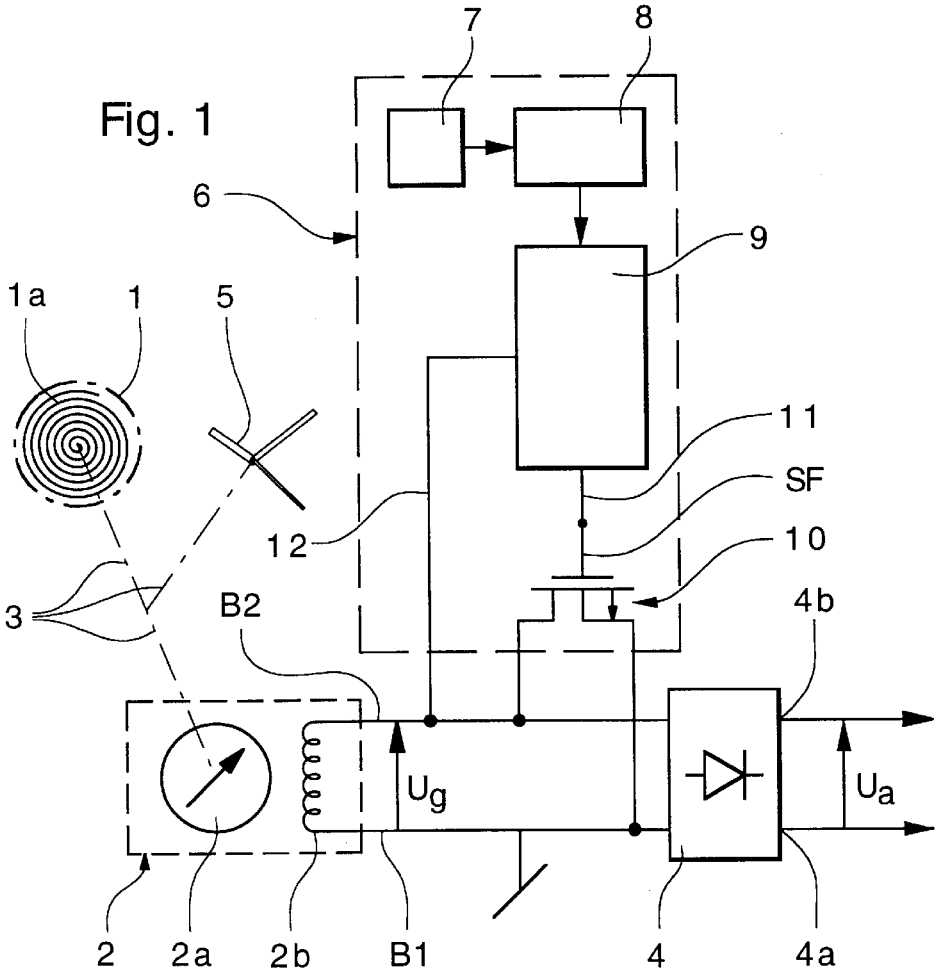
FIG. 1 is general simplified diagram of a timepiece according to invention.

Reference will first be made to FIG. 1 which shows a general simplified diagram of a timepiece according to the invention. It is to be noted that the part of this diagram concerning the regulating circuit intended to control or enslave the rotational speed of the generator of this timepiece, will not be described in detail here, the man skilled in the art being able easily to design this enslaving device with reference to the description of Swiss Patent Application No. 686 332 in the name of the Applicant of the present Patent Application. However, in order to make comprehension of the present invention easier, the essential elements of the diagram and the operation of this regulating circuit will briefly be recalled here.

The timepiece according to the invention includes a mechanical energy source formed by a barrel 1 housing a main spring 1*a* of the usual horological type, with manual or automatic winding.

Barrel 1 is mechanically coupled to the rotor 2*a* of an electric generator 2 via a gear train 3 symbolised by dot and dash lines.

Generator 2 includes a coil 2*b* across whose terminals B1 and B2 is generated an alternating voltage Ug, when rotor 2*a* is driven in rotation, this rotor carrying one or more permanent magnets generating a magnetic field symbolised by an arrow in FIG. 1 and to which coil 2*b* is coupled.

Terminals B1 and B2 of coil 2*b* are connected to a rectifier 4 whose output terminals 4*a* and 4*b* supply a direct voltage Ua originating from alternating voltage Ug and intended to supply the various electronic circuits of the timepiece.

Hands 5 or any other conventional mechanical time display means are coupled to gear train 3 in order to allow display of the current time and possibly of the date and day and other time related indications.

The rotational speed of hands 5 is kept at a constant average value due to a regulating circuit 6 which enslaves or subjects this value to a desired speed Vc.

As described in the aforecited Patent Application, the components of regulator circuit 6 are designed to regulate the rotational speed of rotor 2*a*, so that hands 5 rotate at the speed required to correctly indicate the time, when the rotor rotates at desired speed Vc. Desired speed Vc is for example seven revolutions per second.

Enslaving or regulator circuit 6 includes an oscillator 7 stabilised by a quartz of the horological type and a frequency divider 8 bringing the frequency of this oscillator to a value which can be used by a functional module 9 which controls the gate of a semi-conductor component 10, for example an n type MOS transistor.

This latter is connected via its main circuit to terminals B1 and B2 of coil 2*b* of generator 2. Consequently, this semi-conductor component when made conductive, allows this coil to be short-circuited and thus a braking effect on the rotational movement of generator 2 to be obtained.

The constructive features and the functionality of the various elements which have just been described are designed so that (i) the average rotational speed of rotor 2*a* is greater than that of desired speed Vc, as long as main spring 1*a* is not completely let down, providing that coil 2*b* is not short-circuited, by semi-conductor component 10, and (ii) this average rotational speed is less than desired speed Vc, if coil 2*a* is short-circuited even when main spring 1*a* is completely wound and the driving torque which it provides has a maximum value.

It will also be noted that within the scope of the present invention, the elements and functionality briefly enumerated hereinbefore could be achieved in other ways than that described in the aforecited Patent Application, provided that the rotational speed of the generator is correctly regulated as indicated hereinbefore. This regulation must thus be performed as a function of desired speed Vc required (determined by the correct indication of the time by hands 5) via successive decelerations of generator 2 due to repeated short-circuiting of coil 2*b* of the latter.

The braking control signal SF which circulates on a line 11 between functional module 9 and the gate of semi-conductor component 10 is of the logic type and in the example shown, it is admitted that this signal is in the logic state "0" as long as the timepiece is behind, i.e. as long as the average speed of rotor 2*a* is less than desired speed Vc.

In these conditions, component or transistor 10 remains blocked and rotor 2*a* is not braked.

Conversely, as long as the timepiece is ahead or the average speed of rotor 2*a* is greater than desired speed Vc, braking control signal SF is formed of pulses of determined duration starting at the beginning of each, for example positive alternation of voltage Ug at terminals B1 and B2 of coil 2*b*. During each of these pulses of control signal SF, the latter is in the logic state "1" making transistor 10 conductive and braking rotor 2*a*.

Figure 2:
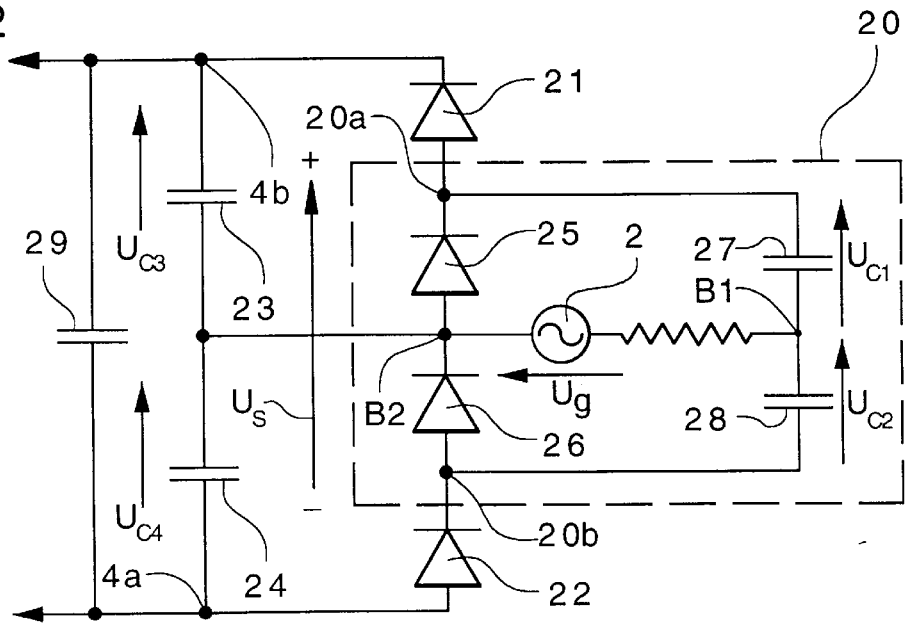
FIG. 2 is a diagram showing the rectifier circuit of the timepiece of FIG. 1.

FIG. 2 illustrates an embodiment according to the invention, of the rectifier circuit shown in FIG. 1. Rectifier circuit 4 includes a voltage doubler rectifier 20, two diodes 21 and 22 and two capacitors 23 and 24.

Voltage doubler rectifier 20, which is connected to output terminals B1 and B2 of the generator is arranged to supply a direct voltage Us through two output terminals 20*a* and 20*b* so that the potential at first output terminal 20*a* is greater than that at said second output terminal 20*b*. Voltage doubler rectifier 20 therefore includes a capacitor 27 and a diode 25 connected in series between first output terminal B2 and second output terminal B1 of generator 2. Diode 25 is oriented so as to allow current to flow from first output terminal B2 to second output terminal B1 of generator 2.

Moreover, voltage doubler rectifier 20 includes a capacitor 28 and a diode 26 connected in series between first output terminal B2 and second output terminal B1 of generator 2. Diode 26 is oriented so as to allow current to flow from second output terminal B1 to first output terminal B2 of generator 2.

The anode of diode 25 is connected to the output terminal of voltage doubler rectifier 20*a*, whereas the cathode of diode 26 is connected to the output terminal of voltage doubler rectifier 20*b*.

Diodes 21, 22, 25 and 26 are preferably of the Schottky type or of the active type in order to limit the voltage drop during their forward drive conduction.

When generator 2 generates a voltage Ug which is positive, i.e. the potential at terminal B2 is greater than the potential at B1, diode 25 is made conductive, and a current flows between terminal B2 and B1 to charge capacitor 27. The latter then has a voltage Uc1 across its plates of approximately Ug, since this capacitor is in this case connected in parallel to generator 2.

Likewise, when generator 2 generates a voltage Ug which is negative, i.e. the potential at terminal B2 is less than the potential at terminal B1, diode 25 is made non-conductive while diode 26 is made conductive. Thus, a current flows between terminal B1 and B2 to charge capacitor 28. This latter will have a voltage Uc2 across its plates of approximately Ug.

Consequently, voltage Us across output terminals 20*a* and 20*b* of voltage doubler rectifier 20 is a direct voltage which has a value equivalent to Uc1+Uc2≈2 Ug (if the voltage drops across diodes 25 and 26 are ignored).

Diode 21 and capacitor 23 are connected in series between output terminal 20*a* of voltage doubler rectifier 20 and output terminal B2 of generator 2. Likewise, diode 22 and capacitor 24 are connected in series between output terminal 20*b* of voltage doubler rectifier 20 and output terminal B2 of generator 2. Diode 21 is oriented so as to allow a current to flow from output terminal 20*a* of voltage doubler rectifier 20 to terminal B2 of generator 2, while diode 22 is oriented so as to allow a current to flow from terminal B2 of generator 2 to output terminal 20*b* of voltage doubler rectifier 20.

The case in which generator 2 generates a voltage Ug which is positive will now be reconsidered. FIG. 2 shows that, in this case, the potential difference across terminal B2 and terminal 20*b* is Uc2+Ug≈2 Ug. Consequently, diode 22 is made conductive and a current flows between terminal B2 and terminal 20*b* through capacitor 24 to charge the latter. Capacitor 24 will then have a voltage Uc4 equivalent to 2 Ug across its plates.

Likewise, when generator 2 generates a voltage Ug which is negative, the potentials difference across terminal 20*a* and terminal B2 is Uc1+Ug≈2 Ug. Consequently, diode 21 is made conductive and a current flows between terminal 20*a* and terminal B2 through capacitor 23 to charge the latter. Thus, capacitor 23 will have a voltage Uc3 equivalent to 2 Ug across its plates.

One understands thus that voltage Ua across output terminals 4*a* and 4*b* of the rectifier circuit is a direct voltage which has a value equivalent to Uc3+Uc4≈4 Ug.

The arrangement shown in FIG. 2 allows the voltage generated by generator 2 to be quadrupled. Thus, even when generator 2 generates a very low voltage Ug, a satisfactory supply voltage may be assured for the electronic circuits associated with the timepiece of the type shown in FIG. 1.

Moreover, for a same supply voltage value, considered by the designer of the timepiece as being a lower threshold for supplying these electronic circuits, the arrangement shown in FIG. 2 has the advantage of requiring less alternating voltage from generator 2. Consequently, generator 2 may be made with a lower number of turns, which involves a lower manufacturing cost.

In an advantageous manner, rectifier circuit 4 of FIG. 2 does not require a high number of cumbersome elements. It is to be noted in FIG. 2 that capacitors 23 and 24 supply, across terminals 4*a* and 4*b*, significant energy to the electronic circuits of the timepiece, while capacitors 27 and 28 are used, in a certain manner, to transfer a charge generated by generator 2 to capacitors 23 and 24. Thus, capacitors 27 and 28 do not need a large capacitance and, in practical embodiments effected within the scope of the present invention, may even be integrated within the electronic circuits. For example, in a circuit made by the inventor, capacitors 23 and 24 each have a value of 2200 nF, while capacitors 27 and 28 each have a value of only 100 nF. Capacitors 27 and 28 preferably have a capacitance between 10 and 100 nF and capacitors 23 and 24 have a capacitance between 100 and 2200 nF, a capacitance 29 between 4*a* and 4*b* having 2200 nF.

It is to be noted that several modifications and/or improvements may be made to the generator system according to the invention without departing from the scope of the latter.

In this connection, it is possible to make a voltage multiplier which multiplies the voltage of generator 2 by a factor of eight, sixteen, etc. while using the same principles described hereinbefore. In order to make a timepiece including a rectifier/multiplier-by-eight, voltage doubler rectifier 20 of FIG. 2 needs only to be replaced by whole rectifier circuit 4 of this Figure.

Likewise, in order to make a timepiece including a rectifier/multiplier-by-sixteen, the rectifier/multiplier-by-eight mentioned in the previous paragraph can be replaced.

What is claimed is:

1. A timepiece including:

a barrel, a spring housed in said barrel, time display members mechanically coupled to said barrel, an electric power generator also mechanically coupled to said barrel and arranged to supply an alternating voltage across first and second output terminals, a rectifier circuit connected to said first and second output terminals of said generator across two respective input terminals and arranged to supply a direct voltage across two output terminals from said alternating voltage, and a regulator circuit supplied by said direct voltage and intended to control the rotational speed of said generator so as to subject said display members to a rotational speed corresponding to a correct indication of the current time, wherein said rectifier circuit comprises, a voltage doubler rectifier connected to said first and second output terminals of said generator and arranged to supply a direct voltage across a first output terminal and a second output terminal so that the potential at said first output terminal is greater than the potential at said second output terminal, a first capacitor and a first diode connected in series between said first output terminal of said voltage doubler rectifier and the first output terminal of said generator, said first diode being oriented in order to allow a current to flow from said first output terminal of said voltage doubler rectifier to said first output terminal of said generator, a second capacitor and a second diode connected in series between said first output terminal of said generator and the second output terminal of said voltage doubler rectifier, said second diode being oriented in order to allow a current to flow from said first output terminal of said generator to said second output terminal of said voltage doubler rectifier.

2. A timepiece according to claim 1, wherein said rectifier circuit comprises:

a third capacitor and a third diode connected in series between said first output terminal and said second output terminal of said generator, said third diode being oriented in order to allow a current to flow from said first output terminal to said second output terminal of said generator, and a fourth capacitor and a fourth diode connected in series between said first output terminal and the second output terminal of said generator, said fourth diode being oriented in order to allow a current to flow from said second output terminal to said first output terminal of said generator.

3. A timepiece according to claim 1, wherein said diodes are of the Schottky type or active type.

4. A timepiece according to claim 1, wherein said first and second capacitors have a capacitance between 100 and 2200 nF.

5. A timepiece according to claim 2, wherein said third and fourth capacitors have a capacitance between 100 and 2200 nF.

6. A timepiece according to claim 5, wherein said third and fourth capacitors are of the integrated type.

* * * * *